US005894541A

United States Patent [19]

Eckert

[11] Patent Number: 5,894,541

[45] Date of Patent: Apr. 13, 1999

[54] ELECTRIC HEATER ASSEMBLY

[76] Inventor: C. Edward Eckert, 260 Lynn Ann Dr., New Kensington, Pa. 15068

[21] Appl. No.: 08/801,769

[22] Filed: Feb. 18, 1997

[51] Int. Cl.[6] ..... H05B 3/40

[52] U.S. Cl. ..... 392/503; 392/497; 392/457; 373/117; 219/548

[58] Field of Search ..... 392/451, 457, 392/487, 497, 498, 503; 373/54, 55, 117; 219/520, 523, 534, 542, 544, 546, 548

[56] References Cited

U.S. PATENT DOCUMENTS 3,665,155 5/1972 Caroleo ..... 219/538

3,719,799 3/1973 Takayasu ..... 219/523

5,474,282 12/1995 Eckert ..... 266/280

*Primary Examiner*—Tu Ba Hoang

*Attorney, Agent, or Firm*—Andrew Alexander

[57] ABSTRACT

An electric heater assembly suitable for heating molten metal, the electric heater assembly having a sleeve comprised of a closed end suitable for immersing in the molten metal. The sleeve is fabricated from a composite material comprised of titanium alloy and having an outside surface to be exposed to the molten metal coated with a refractory resistant to attack by the molten metal; and an electric heater located in the sleeve in heat transfer relationship therewith.

26 Claims, 1 Drawing Sheet

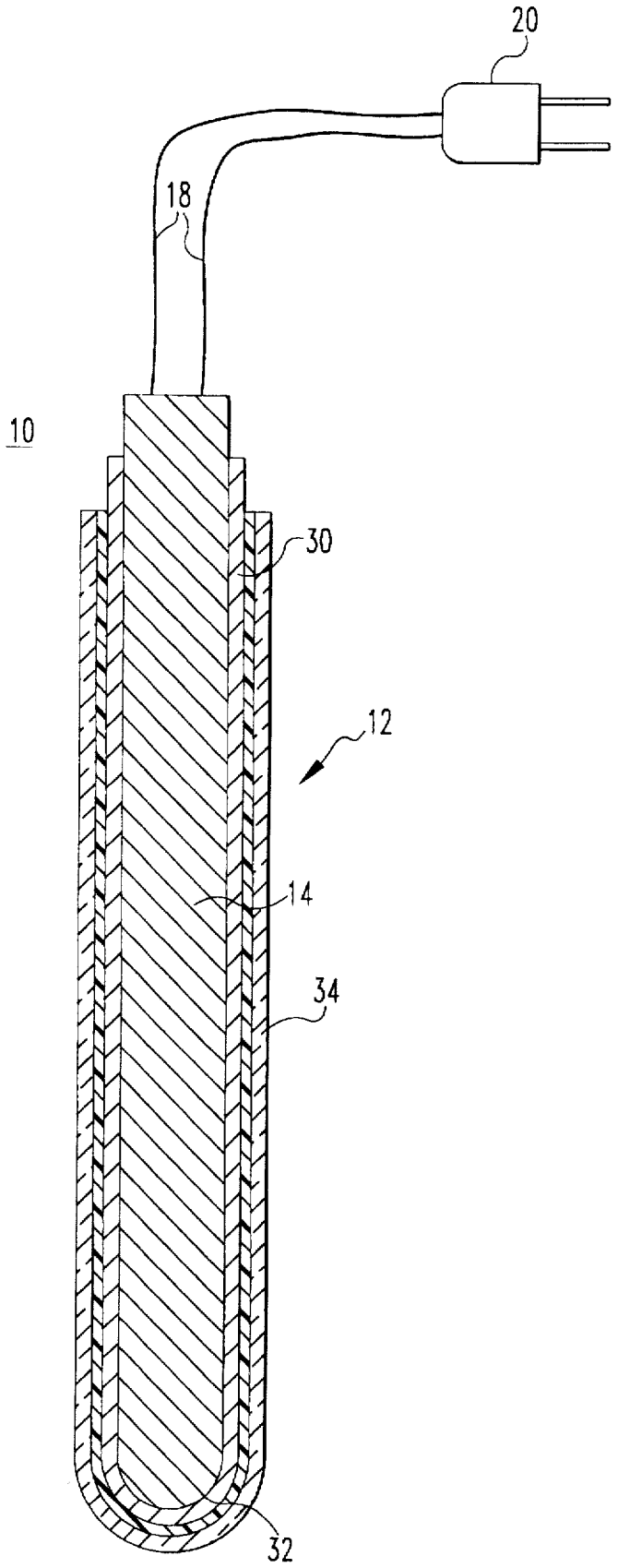
20
18
10
30
12
14
34
32

ELECTRIC HEATER ASSEMBLY

BACKGROUND OF THE INVENTION

This invention relates to electric heaters, and more particularly, it relates to electric heaters suitable for use in molten metals such as molten aluminum.

In the prior art, electric heaters used for molten aluminum are usually enclosed in ceramic tubes. Such electric heaters are very expensive and are very inefficient in transferring heat to the melt because of the air gap between the heater and the tube. Also, such electric heaters have very low thermal conductivity values that are characteristic of ceramic materials. In addition, the ceramic tube is fragile and subject to cracking. Thus, there is a great need for an improved electric heater suitable for use with molten metal, e.g., molten aluminum, which is efficient in transferring heat to the melt. The present invention provides such an electric heater.

SUMMARY OF THE INVENTION

It is an object of the invention to provide an improved electric heater assembly.

It is another object of the invention to provide an improved electric heater assembly for use in molten metal such as molten aluminum.

Yet, another object of this invention is to provide an improved electric heater assembly for use in molten metal, the electric heater assembly having a protective sleeve that has intimate physical contact with the heating element, thereby substantially eliminating the air gap between the heater and sleeve.

And yet, another object of the invention is to provide an improved electric heater assembly for use in molten metal, the electric heater assembly having a protective sleeve having a thermal conductivity of less than 30 BTU/ft hr°F. and having a thermal expansion coefficient of less than $15\times10^{-6}$ in/in/°F. and having a chilling power of less than 5000 $BTU^2/ft^4hr°F$.

And yet, it is a further object of the invention to provide an improved electric heater assembly for use in molten metal, the electric heater assembly having a protective sleeve comprised of a material resistant to erosion or dissolution by molten metal such as molten aluminum.

These and other objects will become apparent from the specification, drawings and claims appended hereto.

In accordance with these objects, there is disclosed an improved electric heater assembly suitable for heating molten metal. The electric heater assembly is comprised of a sleeve having a closed end suitable for heating molten metal, the sleeve fabricated from a composite material comprised of titanium or titanium alloy and having an outside surface to be exposed to the molten metal coated with a refractory resistant to attack by the molten metal. An electric heating element is located in the sleeve in heat transfer relationship therewith for adding heat to the molten metal.

BRIEF DESCRIPTION OF THE FIGURE

The sole figure is a cross-sectional view of an electric heater assembly in accordance with the invention.

DETAILED DESCRIPTION OF THE PREFERRED EMBODIMENTS

Referring to the Figure, there is shown a schematic of an electric heater assembly 10 in accordance with the invention. The electric heater assembly is comprised of a protective sleeve 12 and an electric heating element 14. A lead 18 extends from electric heating element 14 and terminates in a plug 20 suitable for plugging into a power source. A suitable element 14 is available from International Heat Exchanger, Inc., Yorba Linda, Calif. 92687 under the designation P/N HTR2252.

Preferably, protective sleeve 12 is comprised of titanium tube 30 having a closed end 32. While the protective sleeve is illustrated as a tube, it will be appreciated that any configuration that protects or envelops electric heating element 14 may be employed. Thus, reference to tube herein is meant to include such configurations. A refractory coating 34 is employed which is resistant to attack by the environment in which the electric heater assembly is used. A bond coating may be employed between the refractory coating 34 and titanium tube 30. Electric heating element 14 is seated or secured in tube 30 by any convenient means. For example, swaglock nuts and ferrules may be employed or the end of the tube may be crimped or swaged shut to provide a secure fit between the electric heating element and tube 30. In the invention, any of these methods of holding the electric heating element in tube 30 may be employed. It should be understood that tube 30 does not always have to be sealed. In a preferred embodiment, electric heating element 14 is inserted into tube 30 to provide an interference or friction fit. That is, it is preferred that electric heating element 14 has its outside surface in contact with the inside surface of tube 30 to promote heat transfer through tube 30 into the molten metal. Thus, air gaps between the surface of electric heating element 14 and inside surface of tube 30 should be minimized.

If electric heating element 14 is inserted in tube 30 with a friction fit, the fit gets tighter with heat because electric heating element 14 expands more than tube 30, particularly when tube 30 is formed from titanium.

While it is preferred to fabricate tube 30 out of a titanium base alloy, tube 10 may be fabricated from any metal or metalloid material suitable for contacting molten metal and which material is resistant to dissolution or erosion by the molten metal. Other materials that may be used to fabricate tube 30 include silicon, niobium, chromium, molybdenum, combinations of NiF (364 NiFe) and NiTiC (40 Ni 60TiC), particularly when such materials have low thermal expansion and low chilling power, all referred to herein as metals. For protection purposes, it is preferred that the metal or metalloid be coated with a material such as a refractory resistant to attack by molten metal and suitable for use as a protective sleeve.

Further, the material of construction for tube 30 should have a thermal conductivity of less than 30 BTU/ft hr°F., and preferably less than 15 BTU/ft hr°F., with a most preferred material having a thermal conductivity of less than 10 BTU/ft hr°F. Another important feature of a desirable material for tube 30 is thermal expansion. Thus, a suitable material should have a thermal expansion coefficient of less than $15\times10^{-6}$ in/in/°F., with a preferred thermal expansion coefficient being less than $10\times10^{-6}$ in/in/°F., and the most preferred being less than $5\times10^{-6}$ in/in/°F. Another important feature of the material useful in the present invention is chilling power. Chilling power is defined as the product of heat capacity, thermal conductivity and density. Thus, preferably the material in accordance with the invention has a chilling power of less than 5000 $BTU^2/ft^4hr°F.$, preferably less than 2000 $BTU^2/ft^4hr°F.$, and typically in the range of 100 to 750 $BTU^2/ft^4hr°F.$ As noted, the preferred material for fabricating into tubes 30 is a titanium base material or alloy having a thermal conductivity of less than 30 BTU/ft hr°F., preferably less than 15 BTU/ft hr°F., and typically less than 10 BTU/ft hr°F., and having a thermal expansion coefficient less than $15\times10^{-6}$ in/in/°F., preferably less than $10\times10^{-6}$ in/in/°F., and typically less than $5\times10^{-6}$ in/in/°F. The titanium material or alloy should have chilling power as noted, and for titanium, the chilling power can be less than 500, and preferably less than 400, and typically in the range of 100 to 300 BTU/$ft^2$hr°F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements, the chilling power and the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The titanium-base alloy can be a titanium selected from the group consisting of 6242, 1100 and commercial purity (CP) grade. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 A, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material which provides the tube with a molten metal resistant coating. The refractory coating can vary, depending on the molten metal. Thus, a novel composite material is provided permitting use of metals or metalloids having the required thermal conductivity and thermal expansion for use with molten metal which heretofore was not deemed possible.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitride may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 mils, and typically it is less than 2 mils.

The heater assembly of the invention can operate at watt densities of 40 to 120 watts/in$^2$.

The heater assembly in accordance with the invention has the advantage of a metallic-composite sheath for strength and improved thermal conductivity. The strength is important because it provides resistance to mechanical abuse and permits an ultimate contact with the internal element. Intimate contact between heating element and sheath inside diameter provides for substantial elimination of an annular air gap between heating element and sheath. In prior heaters, the annular air gap resulted in radiation heat transfer and also back radiation to the element from inside the sheath wall which limits maximum heat flux. By contrast, the heater of the invention employs an interference fit that results in essentially only conduction.

In conventional heaters, the heating element is not in intimate contact with the protection tube resulting in an annular air gas or space therebetween. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The heater assembly is capable of operating at watt densities of 40 to 120 watts/in$^2$. The low coefficient of expansion of the composite sheath, which is lower than the heating element, provides for intimate contact of the heating element with the composite sheath.

In another feature of the invention, a thermocouple (not shown) may be inserted between sleeve 12 and heating element 14. The thermocouple may be used for purposes of control of the heating element to ensure against overheating of the element in the event that heat is not transferred away sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

While the invention has been described in terms of preferred embodiments, the claims appended hereto are intended to encompass other embodiments which fall within the spirit of the invention.

What is claimed is:

1. An electric heater assembly suitable for heating molten metal, the electric heater assembly comprised of:

(a) a sleeve having a closed end suitable for immersing in said molten metal, the sleeve fabricated from a composite material comprised of titanium alloy and having an outside surface coated with a refractory which is resistant from attack by said molten metal, when said sleeve is exposed to said molten metal; and (b) an electric heating element located in said sleeve in heat transfer relationship therewith for adding heat to said molten metal.

2. The electric heater assembly in accordance with claim 1 wherein the titanium alloy has a thermal expansion coefficient of less than $15\times10^{-6}$ in/in/°F.

3. The electric heater assembly in accordance with claim 1 wherein the titanium alloy has a thermal expansion coefficient of less than $10\times10^{-6}$ in/in/°F. and a chilling power of less than 5000 BTU$^2$/ft$^4$hr°F.

4. The electric heater assembly in accordance with claim 1 wherein the titanium alloy is selected from the group consisting of alpha, beta, near alpha, and alpha-beta titanium alloys having a chilling power of less than 500 BTU$^2$/ft$^4$hr°F.

5. The electric heater assembly in accordance with claim 1 wherein the titanium alloy is selected from the group consisting of 6242, 1100 titanium alloy and commercial purity grade titanium.

6. The electric heater assembly in accordance with claim 1 wherein a bond coating is provided between the titanium alloy sleeve's outside surface and the refractory.

7. The electric heater assembly in accordance with claim 1 wherein the refractory is selected from the group consisting of one of $Al_2O_3$, $ZrO_2$, $Y_2O_3$ stabilized $ZrO_2$, and $Al_2O_3$—$TiO_2$.

8. The electric heater assembly in accordance with claim 1 wherein a bond coating having a thickness in the range of 0.1 to 5 mils is provided between said titanium alloy and said refractory.

9. The electric heater assembly in accordance with claim 1 wherein said refractory has a thickness in the range of 0.3 to 42 mils.

10. The electric heater assembly in accordance with claim 1 wherein a bond coating is provided between said titanium alloy and said refractory and said bond coating comprises an alloy selected from the group consisting of a Cr—Ni—Al alloy and a Cr—Ni alloy.

11. The electric heater assembly in accordance with claim 1 wherein the refractory comprises alumina.

12. The electric heater assembly in accordance with claim 1 wherein the refractory comprises zirconia.

13. The electric heater assembly in accordance with claim 1 wherein the refractory comprises yittria stabilized zirconia.

14. The electric heater assembly in accordance with claim 1 wherein the refractory comprises 5 to 20 wt. % titania and a balance of alumina.

15. The electric heater assembly in accordance with claim 1 wherein the electric heating element has an outside surface in contact with an inside surface of said sleeve.

16. An electric heater assembly suitable for heating molten metal, the electric heater assembly comprised of a sleeve having a closed end suitable for immersing in said molten metal, the sleeve fabricated from a composite material comprised of:

(a) a base metal layer of a titanium alloy;

(b) a bond coat bonded to an outside surface of said base layer to coat said surface to coat said surface to be exposed to said molten metal;

(c) a refractory layer bonded to said bond coat, the refractory layer resistant to attack by said molten metal; and (d) an electric heating element located in said sleeve in heat transfer relationship therewith for adding heat to said molten metal.

17. An electric heater assembly suitable for heating molten metal, the electric heater assembly comprised of a sleeve having a closed end suitable for immersing in said molten metal, the sleeve fabricated from a composite material comprised of:

(a) a base metal layer of a titanium alloy selected from alpha, beta, near alpha, and alpha-beta titanium alloys;

(b) a bond coat bonded to an outside surface of said base layer to coat said surface to coat said surface to be exposed to said molten metal;

(c) a refractory layer bonded to said bond coat, the refractory layer resistant to attack by said molten metal; and (d) an electric heater located in said sleeve in heat transfer relationship therewith for adding heat to said molten metal.

18. The electric heater assembly in accordance with claim 16 wherein said titanium alloy is selected from 6242, 1100 titanium alloys and commercial purity grade titanium.

19. The electric heater assembly in accordance with claim 16 wherein said base metal layer has a coefficient of thermal expansion of less than 5×10–6 in/in/°F.

20. The electric heater assembly in accordance with claim 16 wherein said bond coat has a thickness in the range of 0.1 to 5 mils and said refractory layer has a thickness in the range of 0.3 to 42 mils.

21. The electric heater assembly in accordance with claim 16 wherein said refractory layer is selected from the group consisting of one of $Al_2O_3$, $ZrO_2$, $Y_2O_3$ stabilized $ZrO_2$, and $Al_2O_3$—$TiO_2$.

22. The electric heater assembly in accordance with claim 16 wherein said bond coat comprises an alloy selected from the group consisting of Cr—Ni—Al alloy and Cr—Ni alloy.

23. The electric heater assembly in accordance with claim 16 wherein the ratio of coefficient of expansion of the refractory layer to the base metal layer is in the range of 5:1 to 1:5.

24. An electric heater assembly suitable for heating molten metal, the electric heater assembly comprised of a sleeve having a closed end suitable for immersing in said molten metal, the sleeve fabricated from a composite material comprised of:

(a) a base layer of a titanium alloy;

(b) a bond coat bonded to an outside surface of said sleeve to coat said surface to coat said surface to be exposed to said molten metal;

(c) a refractory layer selected from a material comprising $Al_2O_3$, $ZrO_2$, $Y_2O_3$ stabilized $ZrO_2$, and $Al_2O_3$—$TiO_2$ bonded to said bond coat, the refractory layer resistant to attack by said molten metal; and (d) a heating element located in said sleeve, said heating element having an outside surface in contact with an inside surface of said sleeve.

25. The electric heater assembly in accordance with claim 24 wherein the refractory layer is $Al_2O_3$ and said titanium alloy is selected from 6242, 1100 titanium alloy and commercial purity grade titanium.

26. The electric heater assembly in accordance with claim 24 wherein said base layer has a chilling power in the range of 100 to 700 $BTU^2/ft^4hr°F$.

* * * * *